United States Patent [19]

Buchta et al.

[11] 3,968,392

[45] July 6, 1976

[54] PULSE DISCHARGE LAMP, IN PARTICULAR AN ELECTRONIC FLASH TUBE

[75] Inventors: Hans Peter Buchta, Bremthal; Josef Zimlich, Taunusstein, both of Germany

[73] Assignee: Heimann GmbH, Germany

[22] Filed: Oct. 29, 1974

[21] Appl. No.: 518,725

[30] Foreign Application Priority Data

Dec. 21, 1973 Germany ..... 2364016

[52] U.S. Cl. ..... 313/198; 313/201

[51] Int. Cl.[2] ..... H01J 65/00

[58] Field of Search ..... 313/198, 201

[56] References Cited

UNITED STATES PATENTS

| | | | |
|---|---|---|---|
| 2,508,118 | 5/1950 | Lemmers | 313/198 |
| 3,758,819 | 9/1973 | Goldberg | 313/201 X |

*Primary Examiner*—James B. Mullins
*Assistant Examiner*—Darwin R. Hostetter
*Attorney, Agent, or Firm*—Hill, Gross, Simpson, Van Santen, Steadman, Chiara & Simpson

[57] ABSTRACT

A pulse discharge lamp, in particular an electronic flash tube, includes a substantially cylindrical discharge tube which, at each end, has an electrode which serves as a cathode or anode and which may be mounted on a lead through pin. Each electrode is constructed such that there is substantially uniform interval between the electrode and the discharge vessel wall radially of the electrode. On the external wall of the tube a longitudinal wire, strip coating, transparent coating or the like is carried as an ignition electrode and extend substantially along the interval between the other mentioned electrodes. At least one of the electrodes, or its mounting, has a metal band attached thereto, bent and spread in such a fashion that its distal end lies at a shorter distance from the ignition electrode than the electrode which supports the metal band.

4 Claims, 2 Drawing Figures

PULSE DISCHARGE LAMP, IN PARTICULAR AN ELECTRONIC FLASH TUBE

BACKGROUND OF THE INVENTION

1. Field of the Invention

The present invention relates to a pulse discharge lamp, and more particularly to an electronic flash tube which includes a substantially cylindrical discharge tube having an anode (or cathode) electrode mounted at each end thereof on a lead through pin, and which includes an ignition electrode carried on the external surface of the tube in the form of a longitudinal wire, strip coating, transparent coating, or the like, the ignition electrode extending substantially along the interval between the anode (cathode) electrodes, i.e. over the discharge interval.

2. Description of the Prior Art

Those skilled in the art will appreciate that ignition difficulties occur in discharge lamps of the type mentioned above, which ignition difficulties are caused, among other things, by static charging of the vessel wall and by very long drift discharge distances.

In the past attempts have been made to overcome these difficulties by applying the particular electrode potential to the surrounding discharge vessel wall, thus avoiding disturbances due to charge phenomena. To this end, for example, one electrode space is provided with a coating of barium or the like extending at least up to the end of the ignition electrode, by the use of a gettering substance. Another solution involves the formation of the electrodes in such a fashion that their external periphery is directly touching the vessel wall.

The techniques employed heretofore, and described above, are technically unsatisfactory in the manufacture of discharge tubes, and in particular in the production of pulse discharge lamps because, for example, when carrying out gettering, the formation of the metal mirror is an uncontrolled process, and its cohesion and conductivity are impaired when degasing of the relevant electrodes takes place. The introduction and melting in of large area electrodes touching the vessel wall, however, involves difficulties in manufacture because the electrodes generally must be introduced into tubes of material having a high melting point, and in doing so are sometimes so highly heated that stress cracks or other modifications occur in the vessel wall. Also, the risk of breakage in such arrangements, with electrodes which are in a peripheral contact arrangement, is substantially higher than in other forms.

SUMMARY OF THE INVENTION

The primary object of the invention is to provide measures for reducing the range of fluctuation of the ignition point, in order to reduce the ignition voltage and therefore avoid the difficulties referred to above and providing a reliably operating ignition aid.

Considering a pulse discharge lamp of the type initially mentioned, in particular an electronic flash tube constructed in accordance with the invention, this result is achieved in that on at least one of the electrodes, or on its mounting, a metal band is arranged, attached and then bent and spread in such a fashion that, like a starter, its distal end lies at a shorter distance from the ignition electrode than the electrode associated with the metal band.

Advantageously, for a tube construction in which a pair of electrode pins extend through opposite ends of the vessel wall to provide electrical connection to and to mechanically support respective electrodes, a respective metal band having good thermal conductivity, for example a band made of tantalum, is attached and, at least after assembly, brought into contact with that part of the discharge vessel wall which is provided externally with the ignition electrode.

In many cases, it may be advantageous to fit the metal band of magnetic material in its final position, only after assembly, e.g. using a magnetic impulse for this purpose.

BRIEF DESCRIPTION OF THE DRAWING

Other objects, features and advantages of the invention, its organization, construction and operation will be best understood from the following detailed description of a preferred embodiment of the invention taken in conjunction with the accompanying drawing, on which.

DESCRIPTION OF THE PREFERRED EMBODIMENT

Figure 1:
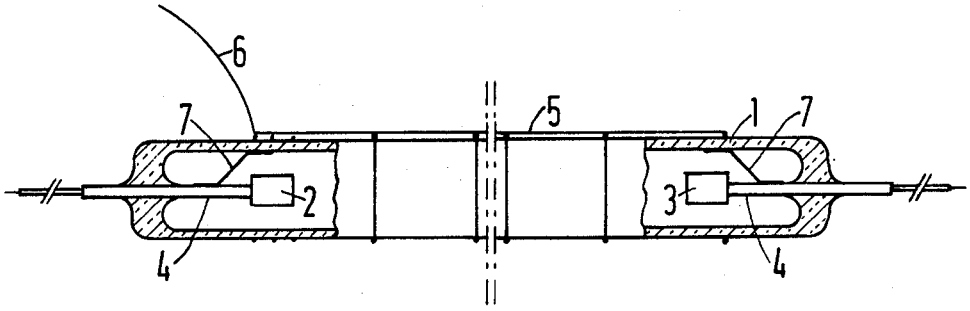
FIG. 1 is an elevational view of a cylindrical electronic flash tube, in particular for pulse operation, with the ends shown in section.

Referring to FIG. 1, a substantially cylindrical discharge tube 1 of a cylindrical electronic flash tube, is provided, at each end thereof with respective electrodes 2 and 3, each of which are attached to and supported by a lead through pin 4. The electrodes 2 and 3 are arranged to function as cathode and anode for the relevant gas discharge interval, the electrodes generally being of disc or flat cylindrical shape. The electrodes 2 and 3 have a smaller radial size than the cross section of the discharge tube so that there is substantially an equal interval about each electrode between the electrode and the inner surface of the tube wall.

Directly outside on the tube wall, along the interval of the electrodes located inside, an ignition electrode is arranged as a substantially elongate wire structure 5, a flat strip having good electrical conductivity, or for that matter having semi conducting characteristics, or a transparent coating of, for example $SnO_2$, InO or the like. An electrical lead 6 is attached to the ignition electrode 5.

Whereas in operation a constant anode voltage sufficient for the particular arc voltage is applied to the two electrodes 2 and 3, to the ignition electrode 5, through the lead 6 and possibly with a high ohmic series resistor, a high voltage ignition pulse is applied from the secondary of a special ignition transformer (not shown) so that the pre-ionized discharge interval (ion path) between the electrodes 2 and 3 is ignited. Unfortunately, with the normal discharge lamp design described above, the point of initiation of ignition is at undesirably high ignition voltage values and also exhibits very considerable spread within a wide ignitability range, e.g. due to unfavorable wall charge influences.

Consequently, in an arrangement constructed in accordance with the invention, there is additionally provided, as an aid to ignition, on at least one electrode, e.g. on its lead through pin, a small metal band 7 of, for example, tantalum or some other elastic metal having good thermal conductivity. One end of the metal band 7 is attached to the relevant electrode, or as illustrated in FIG. 1 to the lead through pin 4 of the relevant electrode, and the distal end lies at a shorter distance to the ignition electrode 5 than the associated electrode. The distal end of the metal band 7 therefore substantially reduces the interval between the relevant electrode and the externally disposed ignition electrode. With this structure, which can be carried out with particular advantage on both electrodes, the ignition interval is effectively shortened by increased capacitive coupling and also by reduction of the spreading effect of wall charges. In the manner illustrated in FIG. 2 a substantially steeper characteristic on the part of the ignitability curves 13 and 14 is achieved compared with that of the curve 11, for example of a normal arrangement without the ignition aid described above.

Figure 2:
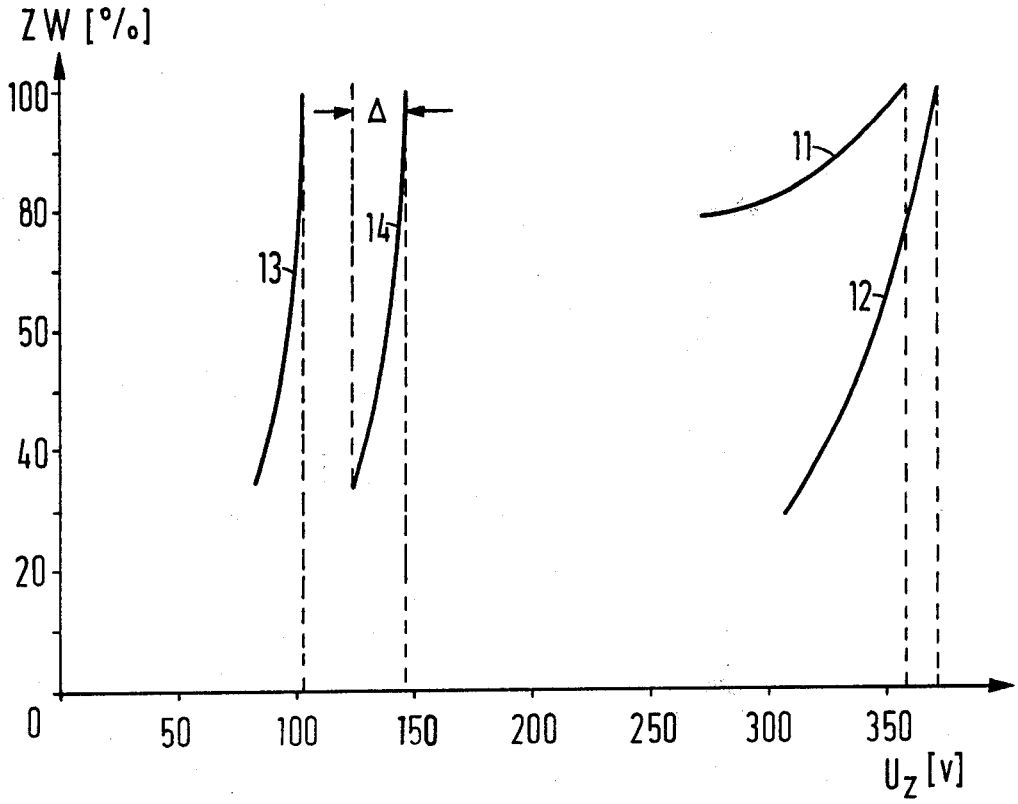
FIG. 2 is a graphic illustration of ignitability, in the neighborhood of the point of initiation of ignition, as a function of the ignition voltage.

In the graphic illustration of FIG. 2, over the primary ignition voltage on the abscissa, the ignitability factors are plotted on the ordinance in percentage form, this in such a fashion that in each case, the top end of a curve represents the 100% value, i.e. the point of initiation of ignition, while the slope of the particular part of the curve signifies the ignition voltage difference between the initiation and termination of the curve, i.e. the spread range $\Delta$ of the ignitability.

Merely by the inclusion of, for example, the two small tantalum bands, the point of initiation of the ignition has been reduced by about 200 volts to between 100 and 150 volts (curves 13 and 14) from a level of more than 350 volts (curves 11 and 12) in prior arrangements, while at the same time the steepness of the ignitability characteristic has over some portion been very considerably increased.

Although we have described our invention by reference to a particular illustrative embodiment thereof, many changes and modifications of the invention may become apparent to those skilled in the art without departing from the spirit and scope of the invention. We therefore intend to include within the patent warranted hereon all such changes and modifications as may reasonably and properly be included within the scope of our contribution to the art.

We claim:

1. A pulse discharge lamp comprising: a gas filled substantially cylindrical discharge vessel; a pair of electrically conducting pins extending through respective ends of said vessel; a pair of electrodes mounted on respective ones of said pins, each of said electrodes spaced a uniform interval from the internal surface of said vessel; an ignition electrode carried on the external surface of said vessel and extending substantially along the interval between and electrically insulated from said electrodes; and a pair of metal bands electrically connected to respective ones of said electrodes, each of said metal bands extending to a respective point which is a shorter distance from said ignition electrode than the respective electrode and including an end at that point which bears against the internal surface of said vessel.

2. A pulse discharge lamp as set forth in claim 1, wherein each of said metal bands comprises tantalum.

3. A pulse discharge lamp as set forth in claim 1, wherein said metal band comprises magnetic material and is responsive to a magnetic impulse for positioning within said vessel.

4. A pulse discharge lamp as set forth in claim 1, wherein each of said metal bands comprises an elastic metal material having good thermal conductivity.

* * * * *